US006561877B1

(12) United States Patent
Lin et al.

(10) Patent No.: US 6,561,877 B1
(45) Date of Patent: May 13, 2003

(54) APPARATUS AND METHOD FOR RETAINING MOISTURE ON A POLISHING PAD

(75) Inventors: Chung-Yang Lin, Hsin-chu (TW); Yu-Sheng Shen, Hsin-chu (TW); Young-Wang Lo, Hsin-chu (TW); Chung-I Cheng, Hsin-chu (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 29 days.

(21) Appl. No.: 09/637,943

(22) Filed: Aug. 11, 2000

(51) Int. Cl.[7] ..... B24B 1/00; B24B 55/02

(52) U.S. Cl. ..... 451/41; 451/56; 451/285; 451/444; 451/450

(58) Field of Search ..... 451/41, 56, 63, 451/285–290, 444, 450, 451

(56) References Cited

U.S. PATENT DOCUMENTS

| | | | | | |
|---|---|---|---|---|---|
| 3,256,647 | A | * | 6/1966 | Hutton | 451/450 |
| 3,616,577 | A | * | 11/1971 | Hutton | 451/450 |
| 4,607,462 | A | * | 8/1986 | Murphy | 451/449 |
| 4,893,369 | A | * | 1/1990 | Johnson | 15/119.2 |
| 5,483,720 | A | * | 1/1996 | Decoopman et al. | 15/118 |

FOREIGN PATENT DOCUMENTS

JP 6-154145 * 6/1994

* cited by examiner

*Primary Examiner*—M. Rachuba
(74) *Attorney, Agent, or Firm*—Tung & Associates

(57) ABSTRACT

An apparatus and a method for retaining moisture on a polishing pad in chemical mechanical polishing during machine idling, i.e. during machine maintenance or repair are described. The apparatus is constructed of a circular disc in a clam-shell configuration having two halves for easy mounting or dismounting from a polishing pad. The circular disc may further include a protruded top portion to accommodate a polishing head when the chemical mechanical polishing apparatus is in a stand-by mode. The circular disc should have a diameter sufficiently large to cover an entire surface area of a polishing pad, while a peripheral edge of the circular disc overlaps a periphery of the polishing pad. The apparatus further includes a moisture retention means mounted on an inner surface of the circular disc for providing a moisturizing environment to the surface of the polishing pad. The moisture retention means can be suitably provided in brushes formed of moisture retaining bristles or in a cellulosic material layer. The apparatus may further include a fastening means for fastening the two clam-shell halves together which includes a hook-and-loop means, an adhesive means or a mechanical quick connect/disconnect means. The circular disc is preferably fabricated of a substantially transparent material, such as a transparent plastic, so that the condition of the polishing pad can be readily observed.

16 Claims, 3 Drawing Sheets

APPARATUS AND METHOD FOR RETAINING MOISTURE ON A POLISHING PAD

FIELD OF THE INVENTION

The present invention generally relates to an apparatus and a method for retaining moisture on a polishing pad in chemical mechanical polishing during machine idling and more particularly, relates to an apparatus and a method for retaining moisture on a polishing pad in chemical mechanical polishing during machine idling by covering the polishing pad with a circular disc equipped with a moisture retention means and a fastening means.

BACKGROUND OF THE INVENTION

Apparatus for polishing thin, flat semi-conductor wafers is well known in the art such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. A CMP apparatus is used primarily for polishing the front face or device side of a semiconductor wafer during the fabrication of semiconductor devises on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1A) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1A is a conditioner arm 32 which is equipped with a rotating conditioner disc 34. The conditioner arm 32 pivots on its base 36 for conditioning the polishing pad 38 for the in-situ conditioning of the pad during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e. over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results from a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is than regrown on the surface while the process is repeated again. For instance, in metal polishing, a metal oxide layer can be formed and removed repeatedly.

Referring now to FIG. 2A, wherein a simplified plane view of the CMP apparatus 10 is shown. In the apparatus 10, a polishing chamber 52 houses a cross member 54 equipped with four spindles 16~22 (shown in ghost lines) . The spindles 16~22 are normally connected to a polishing head 26 through a rotatable shaft (not shown).

A plane view of the CMP apparatus 10 is shown in FIG. 2B illustrating three polishing pads 92,94,96 and a conditioner arm 82. Polishing pads 92,94 and 96 are also shown without the polishing heads in place. It should be noted that for each of the polishing pad positions, i.e. for each of 92,94 and 96, a conditioner arm 82 is utilized for the in-situ conditioning of the respective polishing pads.

A slurry composition is a material that easily dries and accumulates after contacting dry air. When slurry is left on the surface of the process equipment, i.e. on the surface of the polishing pads while the machine is idling during maintenance, it will dry and accumulate to become a source of particle contamination for the wafers that are processed in the polishing chamber. Solid particles easily form on the polishing pad to cause macro-scratch on the wafer surface. Slurry particles may also become sources of particle contamination for the wafer surface and for the chamber environment. It is therefore highly desirable that particle contaminants resulting from dry slurry to be avoided or eliminated.

It is therefore an object of the present invention to provide an apparatus for retaining moisture on a polishing pad in chemical mechanical polishing during machine idling that can be utilized to eliminate the drawbacks or shortcomings of the conventional chemical mechanical polishing apparatus.

It is another object of the present invention to provide an apparatus for retaining moisture on a polishing pad in chemical mechanical polishing during machine idling which is constructed of a circular disc having a protruded top portion.

It is a further object of the present invention to provide an apparatus for retaining moisture on a polishing pad in chemical mechanical polishing during machine idling which is constructed of a circular disc made of a substantially transparent material for covering the polishing pad.

It is another further object of the present invention to provide an apparatus for retaining moisture on a polishing pad in chemical mechanical polishing during machine idling which is constructed of a substantially transparent circular disc having a diameter sufficiently large to cover a surface area of a polishing pad.

It is still another object of the present invention to provide an apparatus for retaining moisture on a polishing pad in chemical mechanical polishing during machine idling which is constructed of a circular disc having a peripheral edge for overlapping a periphery of a polishing pad when the disc is positioned on top of the pad.

It is yet another object of the present invention to provide an apparatus for retaining moisture on a polishing pad in chemical mechanical polishing during machine idling which is constructed of a circular disc in two halves that can be mounted on a polishing pad in a clam-shell configuration.

It is still another further object of the present invention to provide a method for preventing drying of a polishing pad in chemical mechanical polishing during machine idling by first providing a first half and a second half of a circular disc and then mounting the two halves on a polishing pad in a clam-shell construction.

It is yet another further object of the present invention to provide a method for preventing drying of a polishing pad in chemical mechanical polishing during machine idling by first providing a circular disc and then wetting a moisture retention means mounted in the disc before positioning the disc on top of a polishing pad with the moisture retention means contacting the pad surface.

SUMMARY OF THE INVENTION

In accordance with the present invention, an apparatus and a method for retaining moisture on a polishing pad in chemical mechanical polishing during machine idling are provided.

In a preferred embodiment, an apparatus for retaining moisture on a polishing pad in chemical mechanical polishing during machine idling can be provided which includes a first half and a second half of a circular disc, each having a protruded top portion and a peripheral edge extending downwardly in a direction perpendicular to a plane of the circular disc when the two halves are assembled together. The circular disc has a diameter sufficiently large to cover a surface area of a polishing pad with the peripheral edge of the circular disc overlaps a periphery of the polishing pad; a fastening means on an outer surface of the first half and the second half of the circular disc for assembling the two halves together; and a moisture retention means on an inner surface of the first half and the second half of the circular disc for providing a moisturizing environment to the surface area of the polishing pad.

In the apparatus for preventing drying of a polishing pad in chemical mechanical polishing during machine idling, the protruded top portion of the circular disc is off-centered relative to a center of the polishing pad, the protruded top portion of the circular disc being shaped to accommodate a polishing head mounted over and juxtaposed to the polishing pad, the protruded top portion of the circular disc being shaped further to accommodate a polishing head mounted in an operating position for engaging the polishing pad. The first half and the second half of the circular disc may be fabricated of a material that has a transparency sufficient for visual observation. The apparatus may further include a fastening means provided on an outer surface of the first half and the second half of the circular disc that includes a hook-and-loop means, or an adhesive means. The moisture retention means provided on the inner surface of the first and second halves may include bristle means for retention of water therein. The moisture retention means may further include a cellulosic material for retention of water therein. The first half and the second half may be joined together at one end in a clam-shell configuration.

The present invention is further directed to a method for preventing drying of a polishing pad in chemical mechanical polishing during machine idling which can be carried out by the operating steps of first providing a first half and a second half of a circular disc, each having a protruded top portion and a peripheral edge portion extending downwardly in a direction perpendicular to a plane of the circular disc when the two halves are assembled together. The circular disc has a diameter sufficiently large to cover a surface area of a polishing pad with the peripheral edge of the circular disc overlapping a periphery of the polishing pad, a fastening means on an outer surface of the first half and the second half of the circular disc for assembling the two halves together, and a moisture retention means on an inner surface of the first half and the second half of the circular disc for providing a moisturizing environment to the surface area of the polishing pad; wetting the moisture retention means with water; and positioning the first half and the second half of the circular disc on the polishing pad with the moisture retention means contacting the pad.

The method for preventing drying of a polishing pad in chemical mechanical polishing during machine idling may further include the step of fastening the first half and the second half of the circular disc together by a fastening means, such as by a hook-and-loop means or an adhesive means. The method may further include the step of spraying water onto the moisture retention means prior to the positioning step, or the step of providing the moisture retention means in a brush, a sponge or a cellulosic material. The method may further include the step of providing the first half and the second half of the circular disc in a material that has a transparency sufficient for visual observation. The method may further include the step of fastening the first half and the second half of the circular disc together on the polishing pad forming a clam-shell structure.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus for retaining moisture on a polishing pad in chemical mechanical polishing during machine idling or repair. The apparatus is constructed of a first half and a second half of a circular disc each having a protruded top portion and a peripheral edge portion extending downwardly to cover a peripheral edge of a polishing pad. The circular disc has a diameter that is sufficiently large to cover a surface area of a polishing pad. An inner surface of the circular disc is provided with a moisture retention means for providing a moisturizing environment to a top surface of the polishing pad. The apparatus may further be provided with a fastening means of either a hook-and-loop device (for instance, a Velcro™ device), an adhesive device or a mechanical quick connect/disconnect device for assembling the first and second halves of the disc together.

The invention further discloses a method for preventing drying of a polishing pad in chemical mechanical polishing during machine maintenance or repair, or otherwise machine idling. A circular disc that has a protruded top portion and a peripheral edge portion is first provided for covering the top surface of a polishing pad when the pad is not in operation. A moisture retention means mounted on the inside surface of the circular disc is then wetted with water before the circular disc is positioned on a polishing pad with the moisture retention means contacting the pad.

In one embodiment, two symmetrical pad wetting covers are advantageously used in a clam-shell configuration for easy mounting and dismounting to and from a polishing pad. Any suitable fastening means can be used to combine the symmetrical pad wetting covers together, i.e. a Velcro™ means, an adhesive means or a mechanical quick connect/disconnect means. The present invention novel apparatus can be advantageously mounted onto a polishing pad with the polishing head in position since the apparatus is provided with a protruded top portion to accommodate the polishing head, i.e. the polishing head and a head spindle.

Figure 1A:
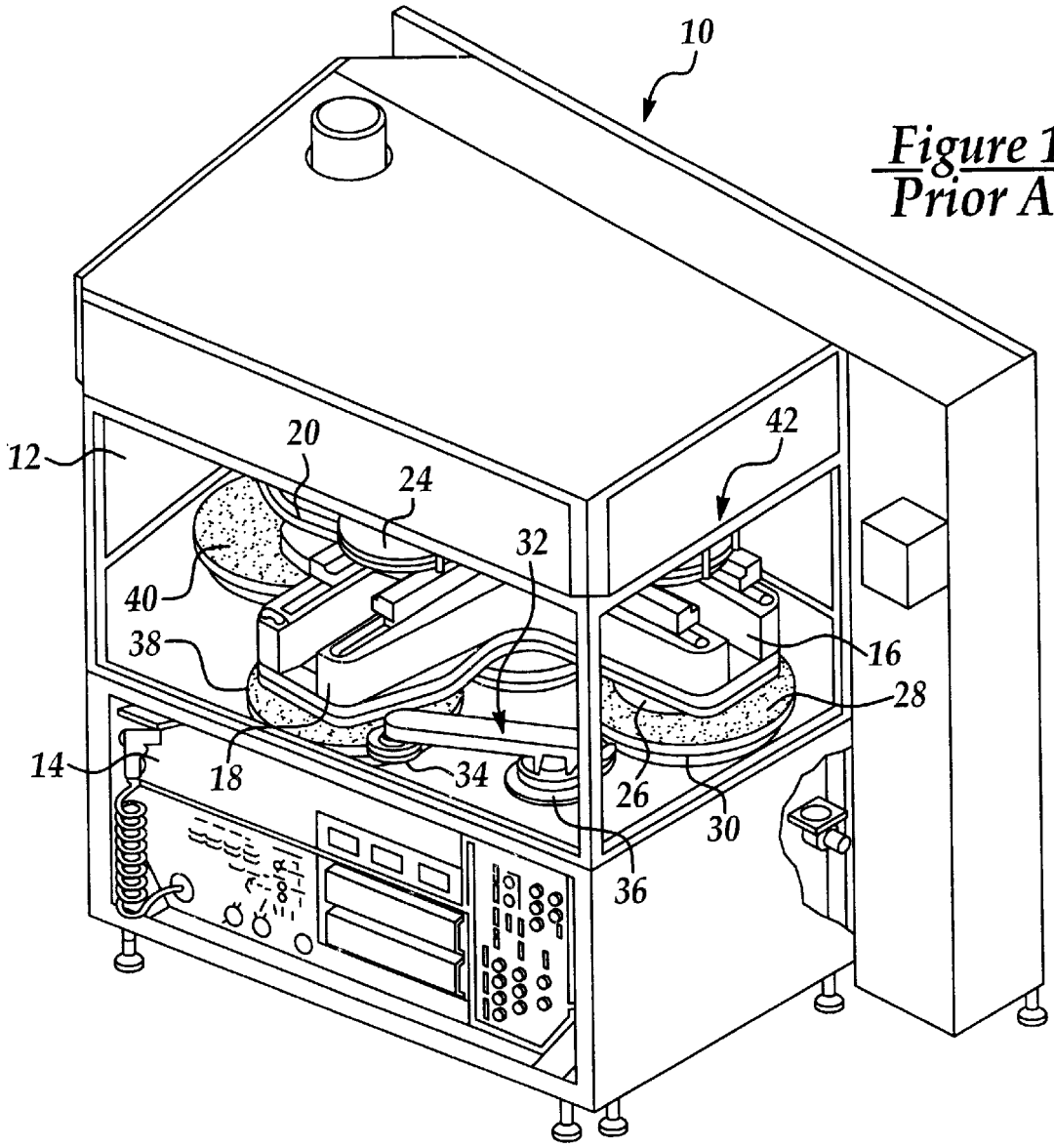
Figure 1A Prior Art
FIG. 1A is a perspective view of a conventional chemical mechanical polishing apparatus.
Figure 1B:
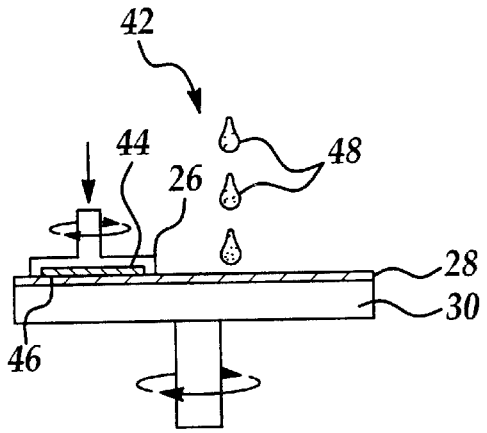
Figure 1B Prior Art
FIG. 1B is a cross-sectional view of a conventional chemical mechanical polishing method with a slurry dispensed to the polishing pad.
Figure 1C:
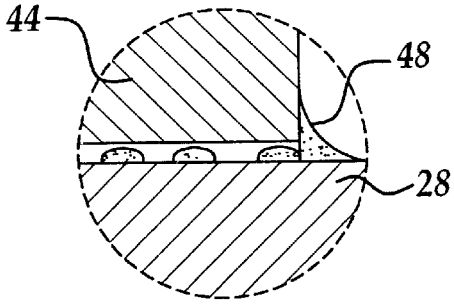
Figure 1C Prior Art
FIG. 1C is an enlarged view illustrating a wafer/slurry/polishing pad interaction in a conventional chemical mechanical polishing process.
Figure 2A:
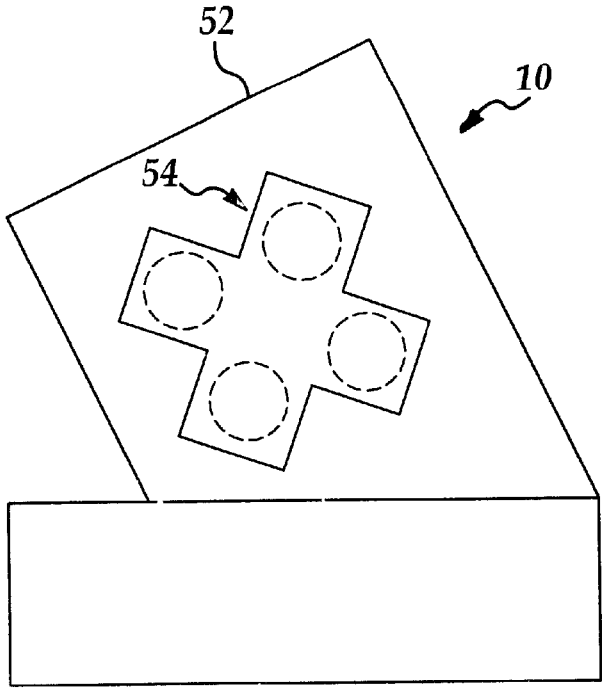
Figure 2A Prior Art
FIG. 2A is a plane view of a conventional chemical mechanical polishing apparatus illustrating a cross-member for mounting the polishing heads.
Figure 2B:
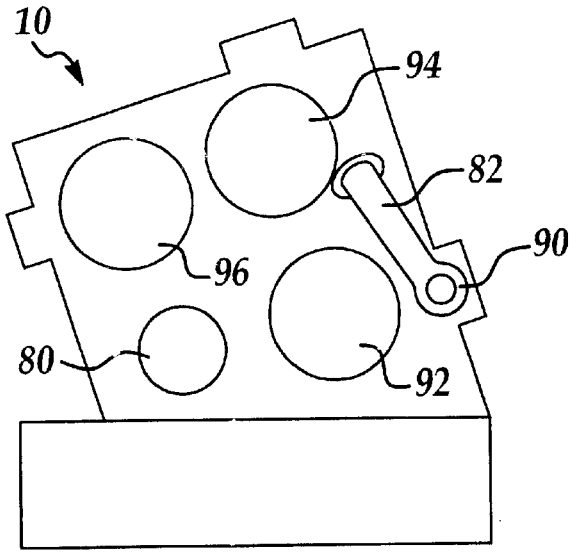
Figure 2B Prior Art
FIG. 2B is a plane view of a conventional chemical mechanical polishing apparatus illustrating three polishing pads and a wafer load/unload station.
Figure 3A:
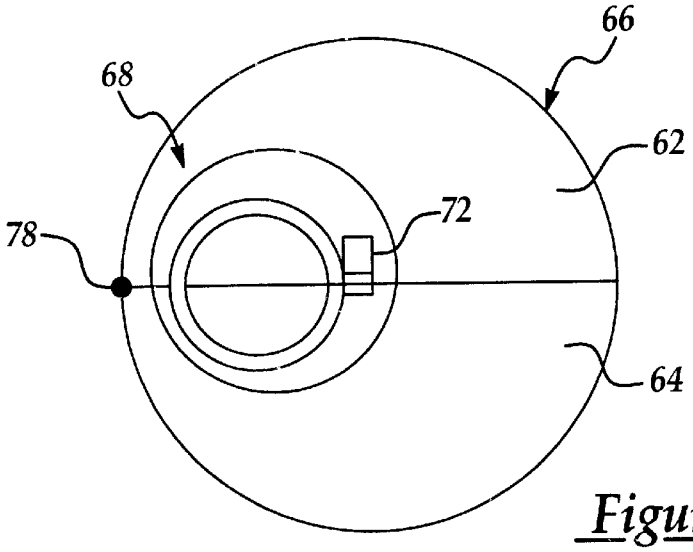
FIG. 3A is a plane view of the present invention apparatus for retaining moisture on a polishing pad in chemical mechanical polishing during machine idling.

Referring now to FIG. 3A wherein a present invention apparatus 60 of a pad wetting cover is shown. The apparatus is constructed of a first half 62 and a second half 64 of a circular disc 66. Each of the first half 62 and the second half 64 is provided with a protruded top portion 68 and a peripheral edge portion 70 extending downwardly from the protruded portion in a direction perpendicular to a plane of the circular disc 66 when the two halves 62,64 are assembled together. The circular disc 66 has a diameter that is sufficiently large to cover a surface area of a polishing pad with the peripheral edge 70 of the disc overlapping a periphery of the polishing pad. For instance, when a 10" diameter polishing head is utilized on a 18" diameter polishing pad, a suitable diameter for the present invention circular disc is about 20" such that there is sufficient room for easy mounting of the disc onto the pad surface.

A fastening means 72, which may be a hook-and-loop type, an adhesive type or a mechanical type is used to clamp the present invention apparatus 60 to a head spindle (not shown) of the polishing head. It should be noted that, in FIGS. 3B and 3C, the head spindle, the polishing head and the polishing pad are not shown for simplicity reasons.

Figure 3B:
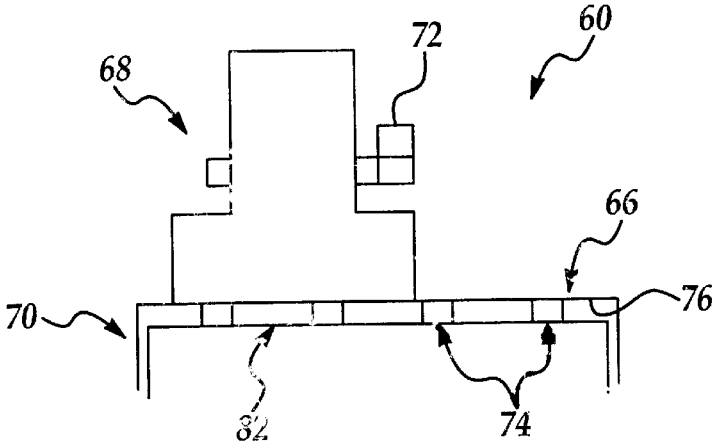
FIG. 3B is a cross-sectional view of the present invention apparatus equipped with a moisture retention means of brushes.

As shown in FIG. 3B, the apparatus illustrated in the specific embodiment is suitable for covering a head spindle of 120 mm diameter, a polishing head of 10" diameter and a polishing pad of 18" diameter. A moisture retention means 74 is also shown in FIG. 3B in the form of a moisture retention brushes which is constructed of moisture retention bristles. While four rows of brushes 74 are shown in FIG. 3B, it should be noted that any suitable number of rows of brushes may be utilized on the inside surface 76 of the circular disc 66.

Figure 3C:
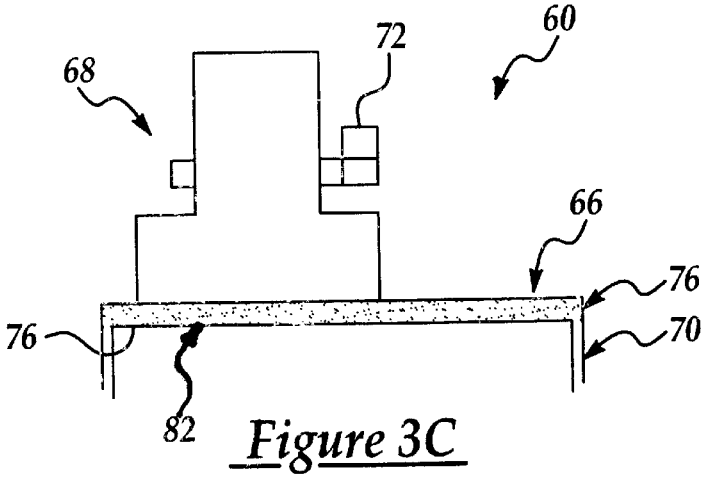
FIG. 3C is a cross-sectional view of the present invention apparatus equipped with a moisture retention means of cellulosic material.

In another preferred embodiment, as shown in FIG. 3C, the moisture retention means utilized is a layer 76 of a cellulosic material that is capable of retaining water.

A suitable construction for the circular disc 66 is a clam-shell configuration of two halves 62,64 that are connected at a hinge 78 at one end of the circular disc 66. The clam-shell configuration can be easily opened and closed by the fastening device 72 provided on the spindle, or the protruded section 68. A most suitable fastening device to be used is a Velcro™ strip which is not only inexpensive, but also easy to use.

In using the present invention novel apparatus, the moisture retention means is first sprayed or otherwise contacted with water such that either the brushes 74 or the cellulosic material layer 76 is saturated with water. The apparatus 60 is then mounted by first opening the clam-shell configuration to the polishing head and polishing pad 82 with the moisture retention means 74,76 contacting a top surface of the polishing pad 82. After the clam-shell configuration is closed onto the polishing head and the polishing pad, the fastening means is used to fasten the two clam-shell halves together such that it stays on the polishing pad. A suitable material for fabricating the circular disc 66 is a substantially transparent material, such as a transparent plastic. Suitable transparent plastics include polymethyl methacrylate (PMMA) or polycarbonate (PC).

The present invention apparatus and method for retaining moisture on a polishing pad in chemical mechanical polishing during machine idling have therefore been amply described in the above description and in the appended drawings of FIGS. 3A–3C.

While the present invention has been described in an illustrative manner, it should be understood that the terminology used is intended to be in a nature of words of description rather than of limitation.

Furthermore, while the present invention has been described in terms of a preferred and an alternate embodiment, it is to be appreciated that those skilled in the art will readily apply these teachings to other possible variations of the inventions.

The embodiment of the invention in which an exclusive property or privilege is claimed are defined as follows:

What is claimed is:

1. A system for chemical mechanical polishing incorporating an apparatus for retaining moisture on a polishing pad during machine idling comprising:

a chemical mechanical polishing apparatus having at least one polishing pad;

a moisture-retaining apparatus for said at least one polishing pad comprising a first half and a second half of a circular disc each having a protruded top portion and a peripheral edge circumferentially extending downwardly in a direction perpendicular to a plane of said circular disc when said two halves are assembled together, said circular disc having a diameter sufficiently large to cover a surface area of said at least one polishing pad with said peripheral edge of said circular disc overlapping a periphery of said at least one polishing pad, a fastening means on an outer surface of said first half and said second half of said circular disc for assembling said two halves together, and a moisture retention means on an inner surface of said first half and said second half of said circular disc for providing a moisturizing environment to said surface area of said at least one polishing pad.

2. A system for chemical mechanical polishing incorporating an apparatus for preventing drying of a polishing pad during machine idling according to claim 1, wherein said protruded top portion in said circular disc being shaped to accommodate a polishing head when said circular disc being mounted over and juxtaposed to said polishing pad.

3. A system for chemical mechanical polishing incorporating an apparatus for preventing drying of a polishing pad during machine idling according to claim 1, wherein said first half and said second half of said circular disc are fabricated of a material having a transparency sufficient for visual observation.

4. A system for chemical mechanical polishing incorporating an apparatus for preventing drying of a polishing pad during machine idling according to claim 1, wherein said fastening means comprises hook-and-loop means.

5. A system for chemical mechanical polishing incorporating an apparatus for preventing drying of a polishing pad during machine idling according to claim 1, wherein said fastening means comprises adhesive means.

6. A system for chemical mechanical polishing incorporating an apparatus for preventing drying of a polishing pad during machine idling according to claim 1, wherein said moisture retention means provided on said inner surface of said first and second halves comprises bristle means for retention of water therein.

7. A system for chemical mechanical polishing incorporating an apparatus for preventing drying of a polishing pad during machine idling according to claim 1, wherein said moisture retention means on said inner surface of said first and second halves comprises a cellulosic material for retention of water therein.

8. A system for chemical mechanical polishing incorporating an apparatus for preventing drying of a polishing pad during machine idling according to claim 1, wherein said first half and said second half are jointed together by a hinge in a clam-shell structure.

9. A method for preventing drying of a polishing pad in chemical mechanical polishing during machine idling comprising the steps of:

providing a first half and a second half of a circular disc each having a protruded top portion and a peripheral edge extending downwardly in a direction perpendicular to a plane of said circular disc when said two halves are assembled together, said circular disc having a diameter sufficiently large to cover a surface area of a polishing pad with said peripheral edge of said circular disc overlapping a periphery of said polishing pad, a fastening means on an outer surface of said first half and said second half of said circular disc for assembling said two halves together, and a moisture retention means on an inner surface of said first half and said second half of said circular disc for providing a moisturizing environment to said surface area of said polishing pad, wetting said moisture retention means with water, and positioning said first half and said second half of said circular disc on said polishing pad with said moisture retention means contacting said pad.

10. A method for preventing drying of a polishing pad in chemical mechanical polishing during machine idling according to claim 9 further comprising the step of fastening said first half and said second half of the circular disc together by a fastening means.

11. A method for preventing drying of a polishing pad in chemical mechanical polishing during machine idling according to claim 9 further comprising the step of fastening said first half and said second half of the circular disc together by a hook-and-loop means.

12. A method for preventing drying of a polishing pad in chemical mechanical polishing during machine idling according to claim 11 further comprising the step of fastening said first half and said second half of the circular disc together by an adhesive means.

13. A method for preventing drying of a polishing pad in chemical mechanical polishing during machine idling according to claim 9 further comprising the step of spraying water onto said moisture retention means prior to said positioning step.

14. A method for preventing drying of a polishing pad in chemical mechanical polishing during machine idling according to claim 9 further comprising the step of providing said moisture retention means in a brush, a sponge or a cellulosic material.

15. A method for preventing drying of a polishing pad in chemical mechanical polishing during machine idling according to claim 9 further comprising the step of providing said first half and said second half of said circular disc in a material that has a transparency sufficient for visual observation.

16. A method for preventing drying of a polishing pad in chemical mechanical polishing during machine idling according to claim 9 further comprising the step of fastening the first half and the second half of the circular disc together on said polishing pad forming a clam-shell structure.

* * * * *